US009537226B2

(12) United States Patent
Krome

(10) Patent No.: US 9,537,226 B2
(45) Date of Patent: Jan. 3, 2017

(54) RJ45 CONNECTOR WITH GUIDE DEVICE FOR CONDUCTORS

(71) Applicant: PHOENIX CONTACT GMBH & CO. KG, Blomberg (DE)

(72) Inventor: Karsten Krome, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 106 days.

(21) Appl. No.: 14/404,441

(22) PCT Filed: May 27, 2013

(86) PCT No.: PCT/EP2013/060871
§ 371 (c)(1),
(2) Date: Nov. 26, 2014

(87) PCT Pub. No.: WO2013/178586
PCT Pub. Date: Dec. 5, 2013

(65) Prior Publication Data

US 2015/0111416 A1 Apr. 23, 2015

(30) Foreign Application Priority Data

May 29, 2012 (DE) ..... 10 2012 104 622

(51) Int. Cl.
*H01R 4/24* (2006.01)
*H01R 24/64* (2011.01)
*H01R 107/00* (2006.01)

(52) U.S. Cl.
CPC ..... *H01R 4/2437* (2013.01); *H01R 4/2433* (2013.01); *H01R 24/64* (2013.01); *H01R 2107/00* (2013.01)

(58) Field of Classification Search
USPC ..... 439/409, 410, 418, 344
See application file for complete search history.

(56) References Cited

U.S. PATENT DOCUMENTS 7,559,790 B2 * 7/2009 Boeck ..... H01R 24/64 439/409
7,815,462 B2 * 10/2010 Boeck ..... H01R 4/2433 439/409

(Continued)

FOREIGN PATENT DOCUMENTS

CN 1835300 9/2006
CN 101145653 3/2008

(Continued)

OTHER PUBLICATIONS

International Search Report dated Aug. 1, 2013, for PCT/EP2013/060871.

(Continued)

*Primary Examiner* — Tho D Ta
(74) *Attorney, Agent, or Firm* — Knobbe, Martens, Olson & Bear LLP

(57) ABSTRACT

The invention relates to an RJ45 connector (1) with a baseboard (10) for connecting to conductors (22) of a cable (20), and with a plurality of insulation displacement contacts (12) to accept the conductors (22), wherein the insulation displacement contacts (12) are arranged in two rows (14, 16) on one side of said baseboard (10), the two rows (14, 16) are positioned at a distance from one another in the longitudinal direction of the cable (20) to be connected, and the RJ45 connector (1) comprises a guide device (30) to guide the conductors (22) for connection to the row (16) of insulation displacement contacts (12) that is further from the end of the cable, wherein the guide device (30) has ramps (34) made in an arc shape to guide the conductors (22).

20 Claims, 10 Drawing Sheets

(56) References Cited

U.S. PATENT DOCUMENTS

Figure 1:
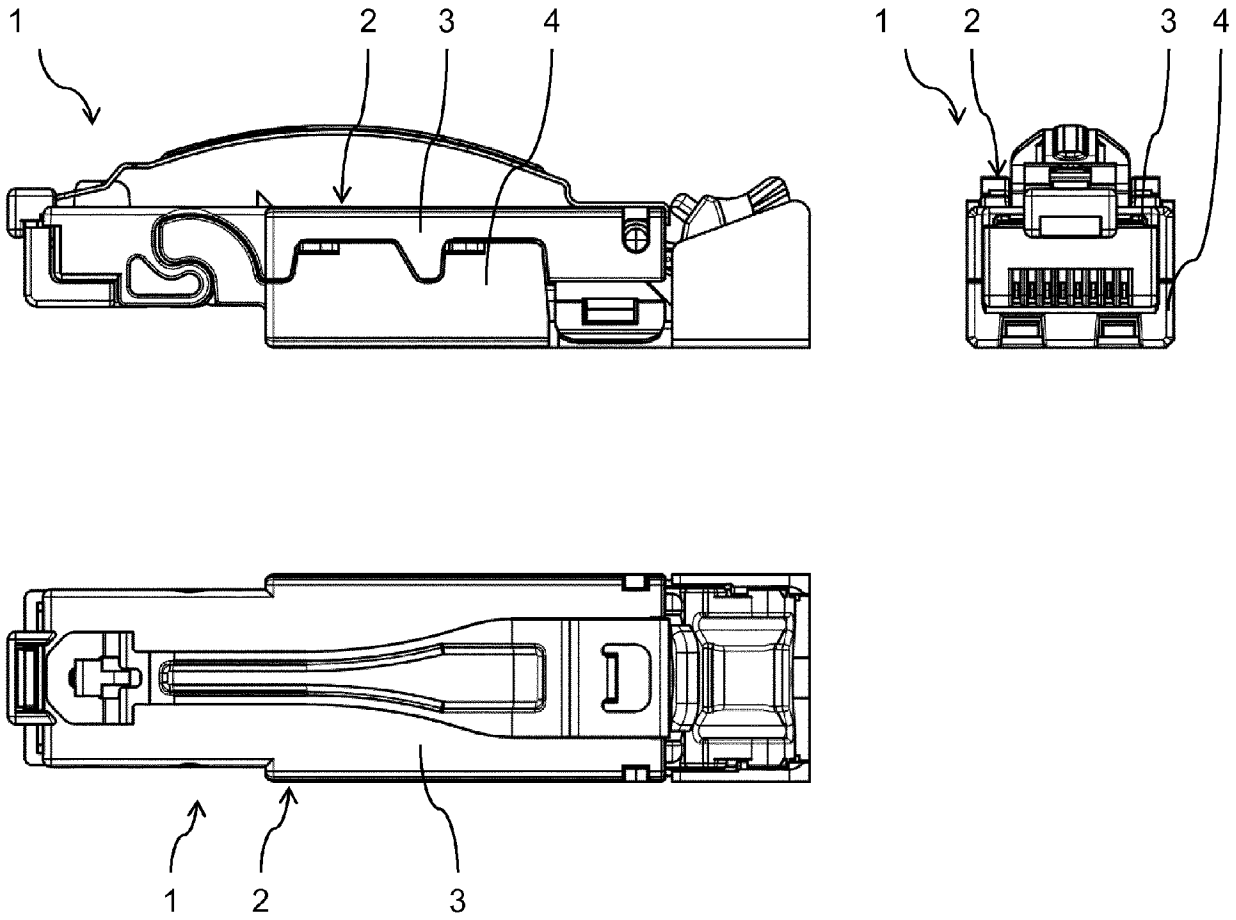

| | | | | |
|---|---|---|---|---|
| 8,192,224 | B2 * | 6/2012 | Schmidt | H01R 24/64 439/409 |
| 2008/0050965 | A1 | 2/2008 | Szelag et al. | |
| 2008/0057793 | A1 | 3/2008 | Gerber et al. | |
| 2008/0200059 | A1 | 8/2008 | Boeck et al. | |
| 2009/0305543 | A1 | 12/2009 | Boeck et al. | |
| 2011/0108306 | A1 | 5/2011 | Parham, Jr. et al. | |
| 2011/0212652 | A1 | 9/2011 | Schmidt et al. | |

FOREIGN PATENT DOCUMENTS

| | | |
|---|---|---|
| DE | 10057833 | 6/2002 |
| EP | 1336225 B1 | 4/2011 |

OTHER PUBLICATIONS

Office Action dated Feb. 3, 2016 in Chinese Application No. 201380028883.0 (with English Translation).

* cited by examiner

RJ45 CONNECTOR WITH GUIDE DEVICE FOR CONDUCTORS

REFERENCE TO RELATED APPLICATIONS

This application is the U.S. National Phase of International Application PCT/EP2013/060871, filed May 27, 2013, and claims priority to DE Application No. 10 2012 104 622.0, filed May 29, 2012. Each of the priority applications is hereby incorporated by reference in its entirety.

The present invention relates to an RJ45 connector with a baseboard for connecting to conductors of a cable, and with a plurality of insulation displacement contacts to accept the conductors, wherein the insulation displacement contacts are arranged in two rows on one side of the baseboard, and the two rows are positioned at a distance from one another in the longitudinal direction of the cable to be connected.

RJ45 connectors of this type are usually used for data cabling, in particular in accordance with the Twisted Pair standard. A data cable of this type comprises eight individual conductors, which can be connected via the RJ45 connector to a corresponding female connector. To this end, the individual conductors of the cable have to be contacted in the RJ45 connector, for which purpose a baseboard with a plurality of insulation displacement contacts arranged thereon is usually provided. The insulation displacement contacts are arranged in two parallel rows, each formed of four individual contacts, wherein the two rows are positioned at a distance from one another in the longitudinal direction. It is thus possible to produce RJ45 connectors of this type with a small width, such that a compact connector is provided. This is advantageous in particular in the case of patch panel cabling, since in that case the RJ45 connectors are plugged directly side by side into corresponding female connectors. The insulation displacement contacts can be positioned in the individual rows exclusively side by side or also with a small offset, such that two insulation displacement contacts in the longitudinal direction are laterally offset in relation to the two other insulation displacement contacts, and the conductors can extend toward the rear two insulation displacement contacts between or to the side of the front insulation displacement contacts.

In the case of these RJ45 connectors, it is difficult to connect the conductors to the corresponding insulation displacement contacts. Due to the small size of the RJ45 connector and the small cross section of the individual conductors, a manual connection is time-consuming.

In order to facilitate the contacting of the conductors with the insulation displacement contacts, the insulation displacement contacts of the two rows are usually arranged in such a way that the contacting by the conductors in the two rows is established in different planes based on a plane of the baseboard. It is thus either necessary to use different insulation displacement contacts, as is known for example from U.S. Pat. No. 7,874,849 B2. Alternatively, the baseboard may have a structure with two planes. In both cases the production of the RJ45 connector is complex.

In principle, it is also known to facilitate the connection of the conductors to the insulation displacement contacts by means of a guide device. In particular, the connection to the row of insulation displacement contacts that is further from the end of the cable has proven to be difficult in practice, since the conductors have to be connected over a large distance from the end of the cable and accidental contacting of the row of insulation displacement contacts close to the end of the cable has to be avoided. The guide device guides the conductors to the respective insulation displacement contacts.

Proceeding from the above-mentioned prior art, the object of the invention is thus to specify an RJ45 connector of the above-mentioned type that enables simple connection to conductors of a cable, that has a simple structure and that can be produced efficiently and cost-effectively with few different parts.

The object is achieved in accordance with the invention by the features of the independent claim. Advantageous embodiments of the invention are specified in the dependent claims.

An RJ45 connector with a baseboard for connecting to conductors of a cable, and with a plurality of insulation displacement contacts to accept the conductors is thus specified in accordance with the invention, wherein the insulation displacement contacts are arranged in two rows on one side of the baseboard, the two rows are positioned at a distance from one another in the longitudinal direction of the cable to be connected, and the RJ45 connector comprises a guide device to guide the conductors for connection to the row of insulation displacement contacts that is further from the end of the cable, wherein the guide device has ramps made in an arc shape to guide the conductors.

The basic concept of the present invention is thus to enable a purposeful guidance of the conductors to the insulation displacement contacts as a result of the arc-shaped ramps. Here, the conductors are also positioned on the ramps via the guide. In particular, proceeding from the start of the ramp, the conductors can be guided in a different plane based on the baseboard so as to easily contact the insulation displacement contacts of the row that is further from the end of the cable, for example. The ramps are preferably formed with a trough-shaped cross section so as to ensure a lateral guidance of the conductors. The arc-shaped embodiment of the ramps enables a continuous guidance of the conductors, for example since the conductors are slid into the guide device. At the same time as the conductors are slid in, the conductors are guided into the desired position thereof and are bent where applicable. The arc shape of the ramps makes it possible for the conductors to be able to rest uniformly against the ramps. The conductors or cores can be embodied arbitrarily here, either as individual conductors or as a bundle of individual conducting wires. The insulation displacement contacts can be arranged in different ways in the two rows. The insulation displacement contacts may each be arranged without offset in the longitudinal direction so as to form the respective row. Alternatively, the insulation displacement contacts in a row may be offset in relation to one another in the longitudinal direction, such that the width of the row is smaller than four times the width of the insulation displacement contacts, for example with two groups of two offset in the longitudinal direction, which are positioned on the baseboard in a manner offset in the transverse direction. Accordingly, in the case of the offset row, two conductors are guided between or beside insulation displacement contacts in order to contact the rear group of offset insulation displacement contacts. The longitudinal direction is defined by the longitudinal direction of the cable to be connected, which usually also corresponds to the direction in which the insulation displacement contacts are oriented in order to accept the conductors.

In accordance with a preferred embodiment of the invention, the guide device is configured to guide all conductors of the cable for connection to the insulation displacement contacts. It is thus ensured that all conductors can be easily connected to the corresponding insulation displacement contacts in a simple manner. Accordingly, the conductors are guided to the insulation displacement contacts of the two rows such that a joint contacting of the insulation displacement contacts can be established, for example.

In accordance with a preferred development of the invention, the ramps are open on the side thereof facing the baseboard. The insulation displacement contacts accordingly can contact the conductors directly on the ramps.

In accordance with a preferred development of the invention, the guide device has insertion openings, into which the conductors can be introduced. The insertion openings are preferably oriented in the direction of the end of the cable. The insertion openings, which are preferably configured to surround the conductors fully, cause a precise guidance of the conductors. The conductors are prevented from sliding out accidentally from the guide device. It is particularly preferable if the guide device is formed in such a way that insertion openings and ramps are combined. It is also preferable if the guide device is formed in such a way that insertion openings and ramps adjoin one another. The conductors are thus fed in a precise manner to the ramps, which facilitates the positioning of the conductors. The insertion openings and the ramps are particularly preferably formed in such a way that the insertion openings form a tangential continuance of the ramps. In particular, the insertion openings are formed on a side of the guide device facing the end of the cable so as to accept the conductors.

In accordance with a preferred development of the invention, the insulation displacement contacts of the first and the second row are identical. Accordingly, just one type of insulation displacement contact is necessary to produce the RJ45 connector. Due to the guidance of the conductors in the guide device, it is possible to easily contact the insulation displacement contacts of the rear row by the conductors. A risk of accidental contacting of the insulation displacement contacts of the first row is avoided due to the guidance. The conductors are particularly preferably guided to the insulation displacement contacts of the second row from a first plane above the insulation displacement contacts to a second plane, in which the insulation displacement contacts are arranged.

In accordance with a preferred embodiment of the invention, the guide device is also configured to guide the conductors, starting from the baseboard, above the insulation displacement contacts of the first row for connection to the insulation displacement contacts of the second row. Accordingly, the RJ45 connector can be configured with small transverse dimensions, since the conductors are guided to the insulation displacement contacts of the second row above the baseboard and the insulation displacement contacts of the first row. All conductors can thus be guided uniformly to the insulation displacement contacts of the second row.

In accordance with a preferred development of the invention, the RJ45 connector comprises a housing, on which the guide device is held. Due to the positioning of the guide device on the housing, a fixed position for the guided conductors is produced, which facilitates handling. The insulation displacement contacts can also be contacted easily due to the predefined position of the guide device on the housing.

In accordance with a preferred embodiment of the invention, the housing has two housing shells, and the baseboard is mounted on the first housing shell and the guide device is mounted on the second housing shell. Accordingly, the conductors can be easily inserted into the guide device due to the physical separation of the baseboard and the guide device. A definition of the first and second housing shell is given here merely from the connection thereof to the baseboard or the guide device. The RJ45 connector is particularly preferably formed in such a way that, when the two housing shells are brought together, the conductors are automatically contacted with the insulation displacement contacts.

In accordance with a preferred development of the invention, the housing shells are interconnected pivotably. The housing shells are thus already held to one another and can be brought together by simple pivoting in such a way that they form the housing. The pivoting enables a precise positioning of the conductors in the insulation displacement contacts. The RJ45 connector is particularly preferably formed in such a way that, when the two housing shells are pivoted relative to one another, the conductors are automatically contacted with the insulation displacement contacts.

In accordance with an advantageous embodiment of the invention, the baseboard is mounted parallel to a wall of the housing. The baseboard can thus be fitted easily in the housing, and therefore the RJ45 connector can be easily produced and is of simple structure.

In accordance with an advantageous embodiment of the invention, the guide device has immersion pockets for accepting the insulation displacement contacts. Due to the immersion pockets, the insulation displacement contacts can enter the guide device and contact the conductors in the guided position. In particular, the conductors can thus be supported on the guide device in a region in front of and behind the immersion pockets, which facilitates the contacting by the insulation displacement contacts.

In accordance with an advantageous embodiment of the invention, the guide device has clamping elements and is configured to hold the conductors in a clamped manner by means of the clamping elements. Due to the fact that the conductors are held in the guide device, these cannot accidentally exit from the guide device, for example when contacted by the insulation displacement contacts. The clamping elements can be formed for example as side clamping walls. Accordingly, the conductors can be clamped over a predefined axial portion. The clamping elements are particularly preferably formed in such a way that they are combined with immersion pockets. The clamping elements are each further preferably formed on both sides of the immersion pockets so as to position and hold the conductors in the immersion pockets in a precise manner.

In accordance with an advantageous embodiment of the invention, the guide device has a guide portion, which extends in a plane parallel to the baseboard. Due to the parallel guidance, the insulation displacement contacts can be contacted easily.

In accordance with a particularly preferred embodiment of the invention, the guide device is produced from plastic. The embodiment of the guide device from plastic facilitates the insulation of the conductors in the RJ45 plug. In addition, the guide device can be easily produced, for example in a plastics injection moulding process. The guide device is particularly preferably produced in one piece.

The invention will be explained in greater detail hereinafter with reference to the accompanying drawing on the basis of preferred embodiments.

In the drawings

Figure 2:
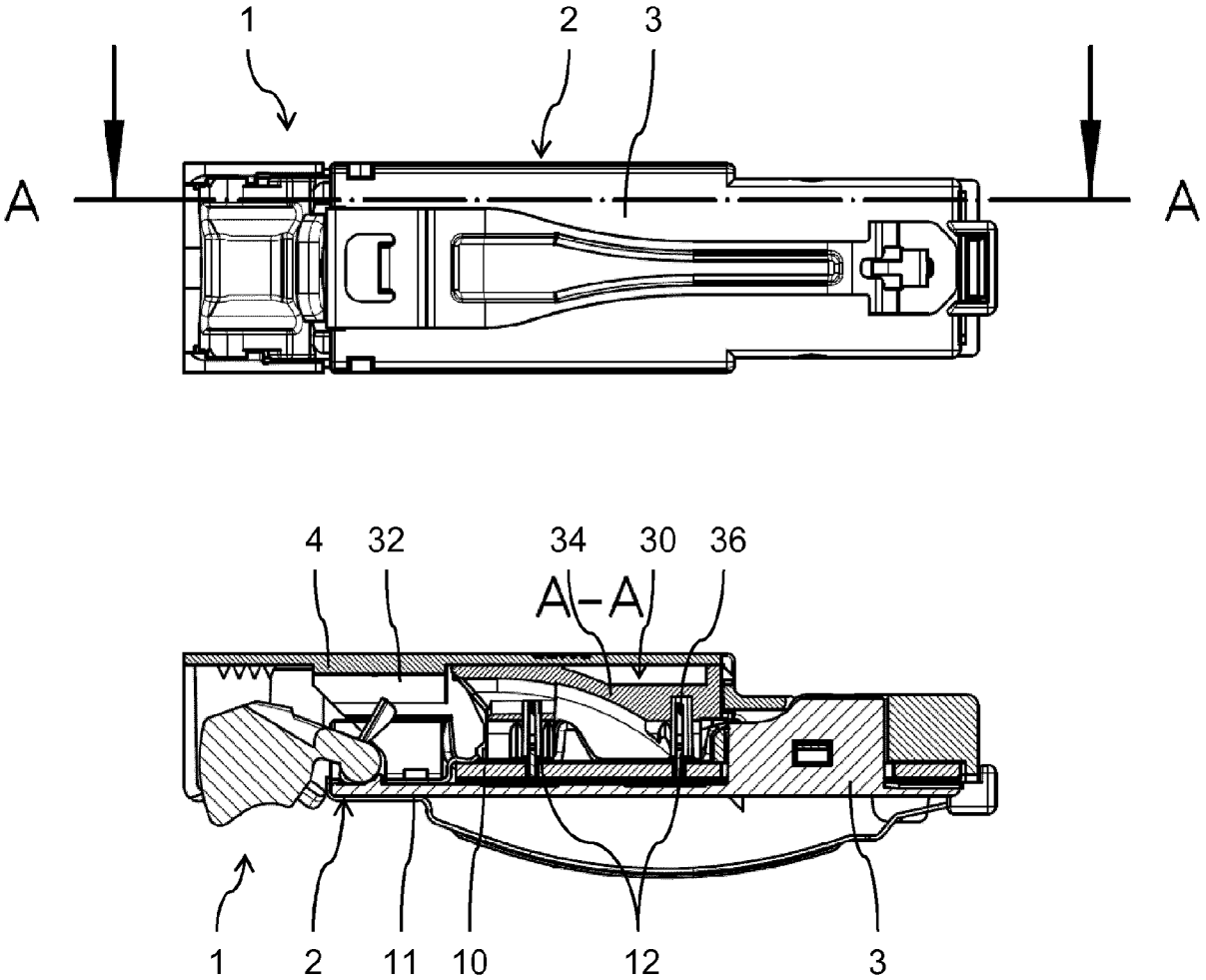
Figure 3:
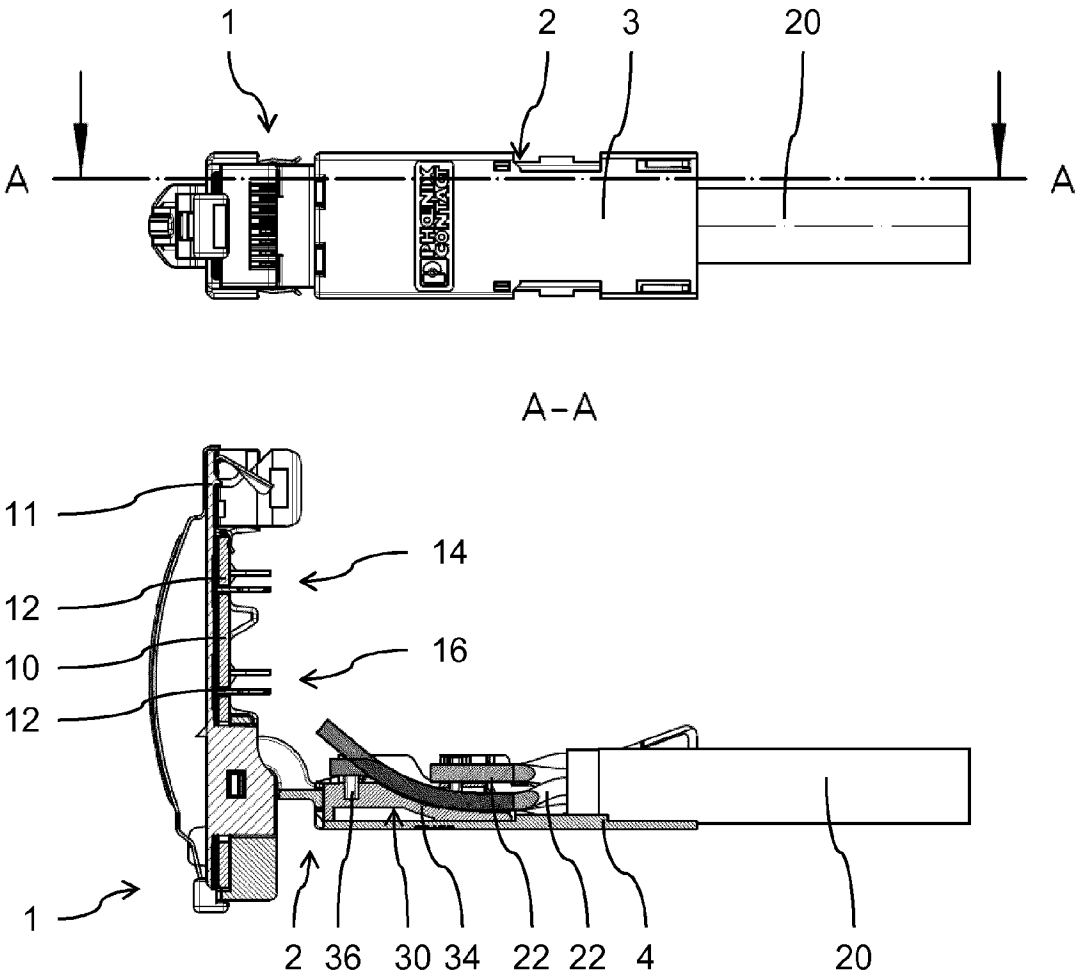
Figure 4:
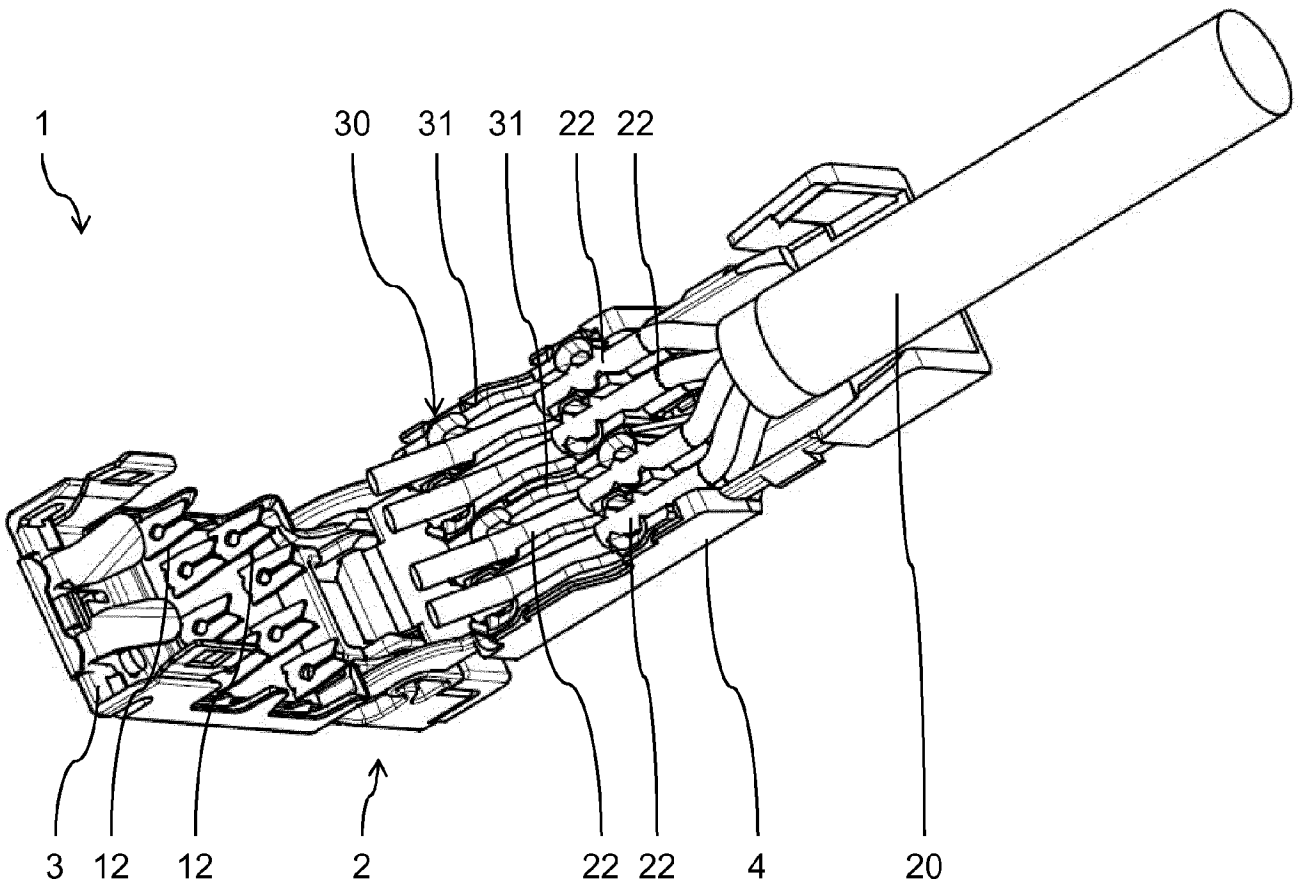
Figure 5:
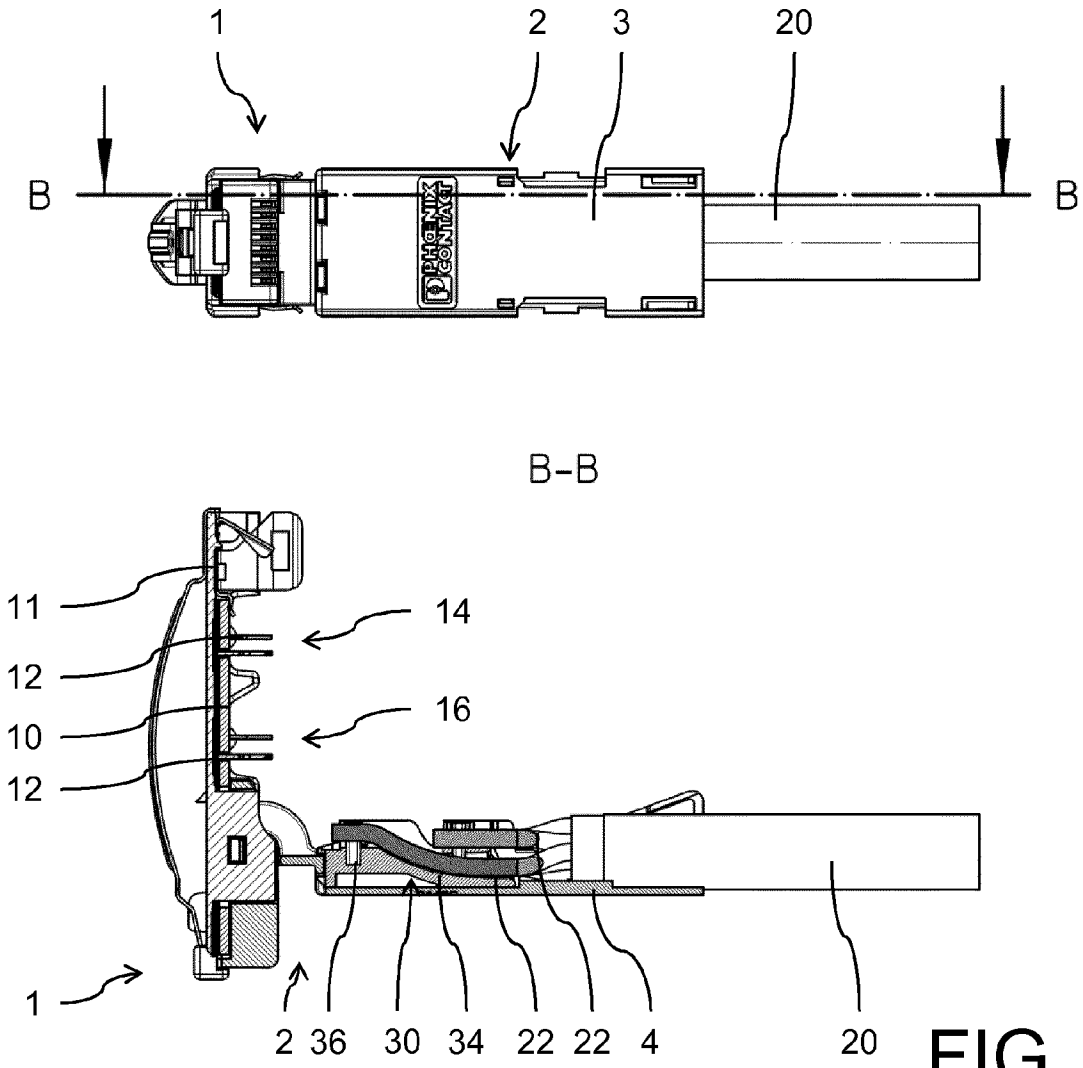
Figure 6:
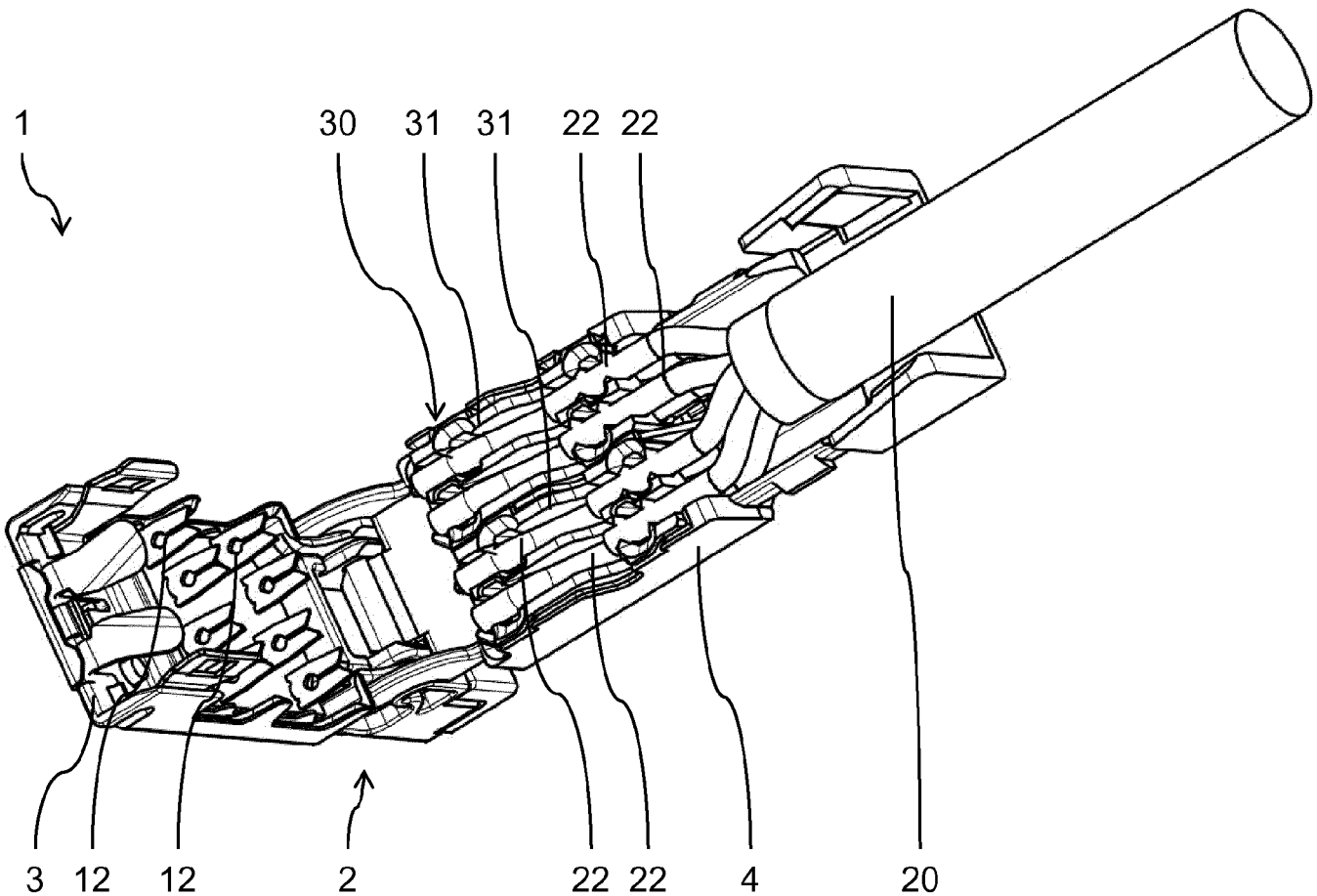
Figure 7:
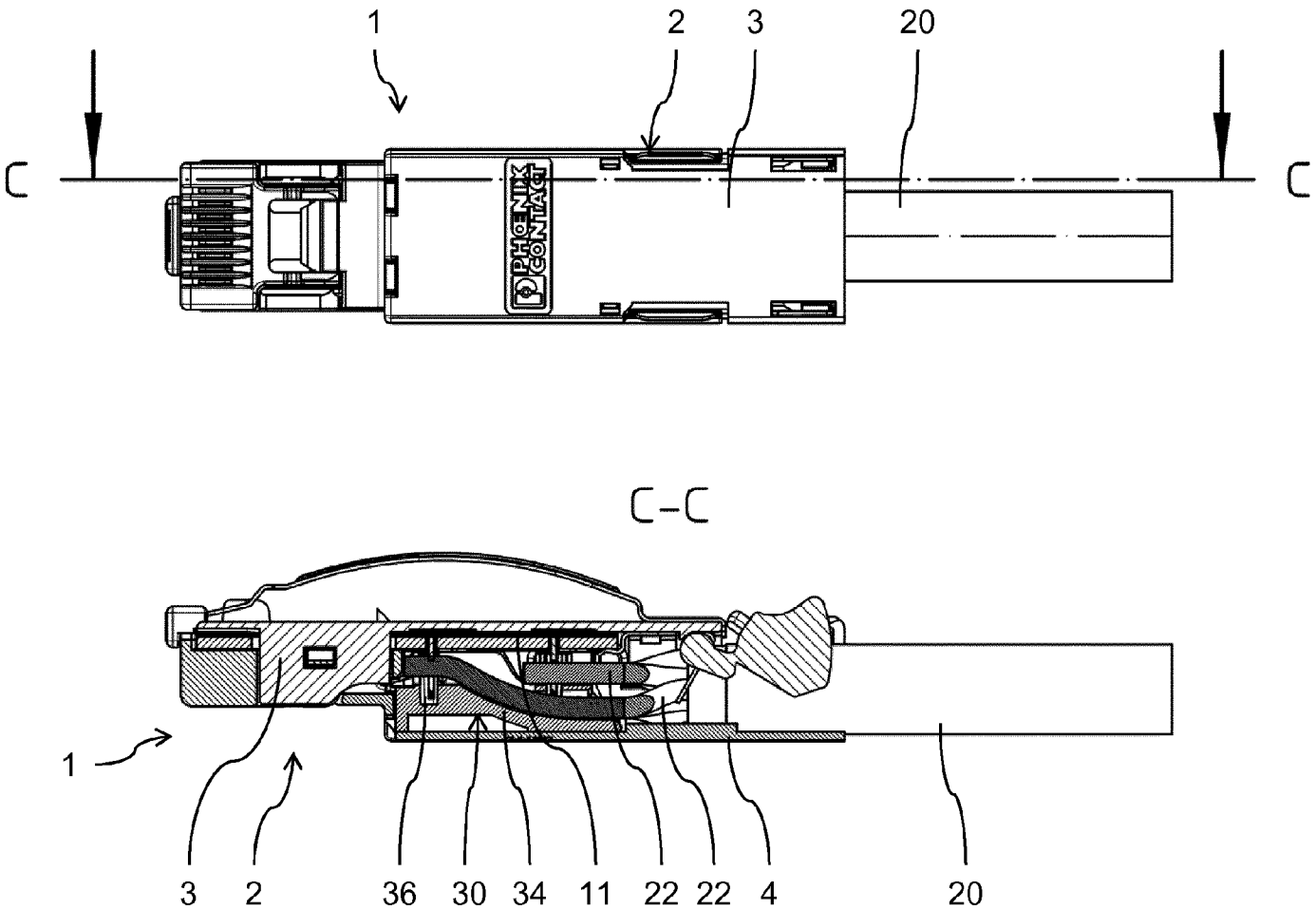
Figure 8:
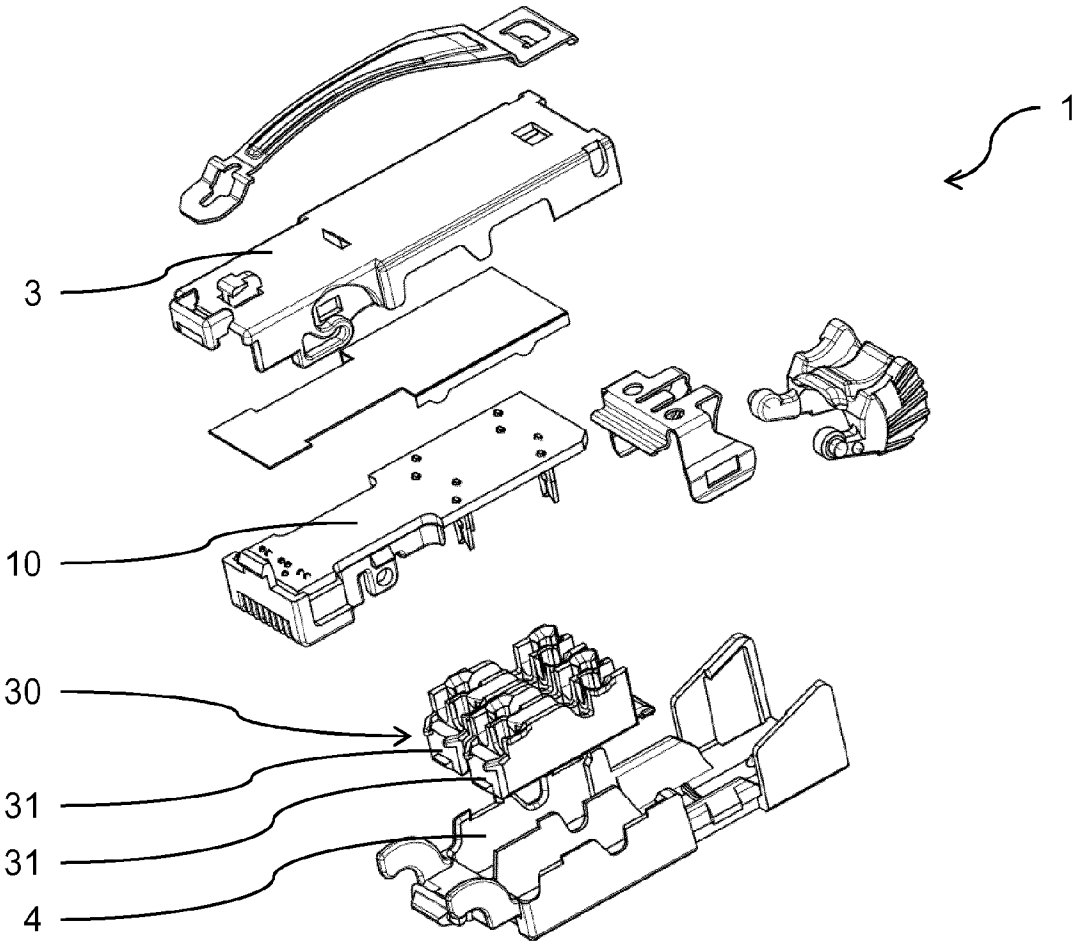
Figure 9:
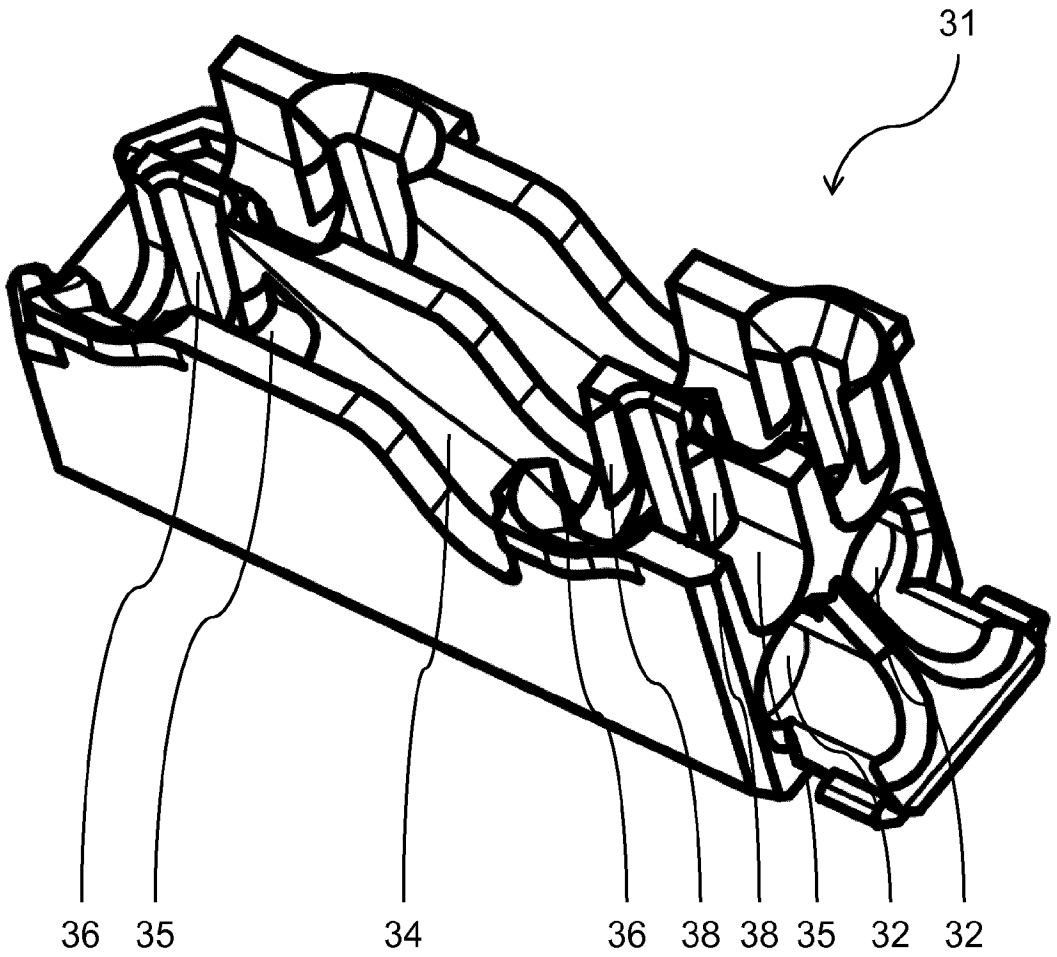
Figure 10:
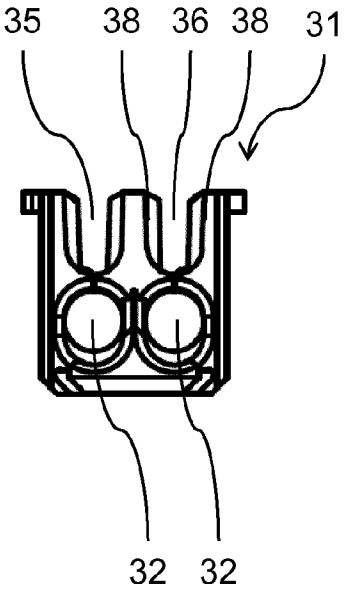
Figure 10:
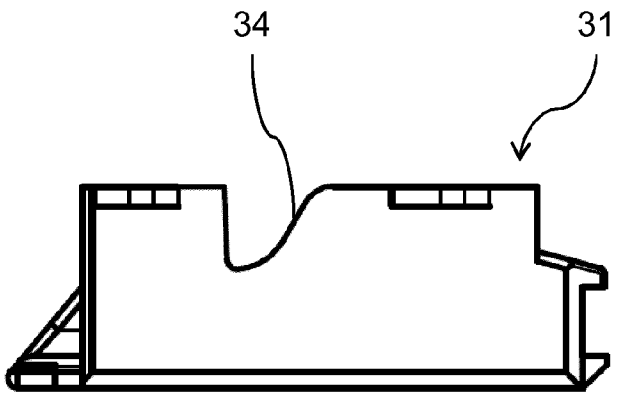
Figure 10:
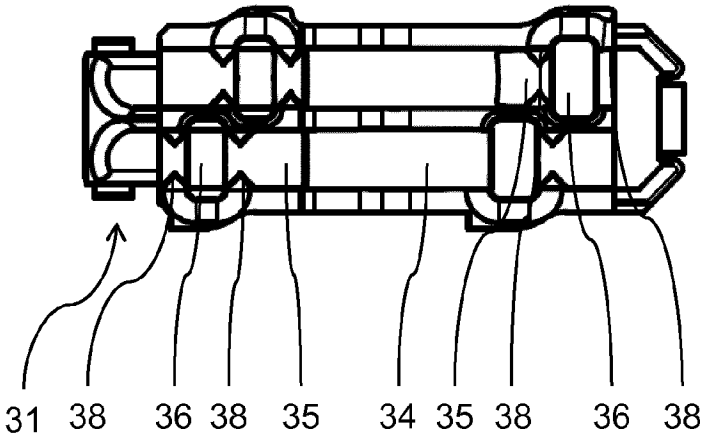

FIG. 1 shows an RJ45 connector in accordance with an embodiment of the present invention in three views, FIG. 2 shows the RJ45 connector from FIG. 1 in a plan view and along a line of section A-A, FIG. 3 shows the RJ45 connector from FIG. 1 with a connected cable in a plan view and a sectional view along a line of section A-A, wherein the RJ45 connector is illustrated in the sectional view in an open state, FIG. 4 shows a perspective view of the open RJ45 connector from FIG. 3, FIG. 5 shows the view from FIG. 3 additionally with conductors clamped in the guide device, FIG. 6 shows a perspective view of the illustration of the open RJ45 connector with the clamped conductors from FIG. 5, FIG. 7 shows the RJ45 connector according to the views in FIG. 5 in the closed state, FIG. 8 shows an exploded illustration of the RJ45 connector according to the invention from FIG. 1, FIG. 9 shows an isolated view of a guide element of the RJ45 connector from FIG. 1, and FIG. 10 shows an illustration of the guide element from FIG. 9 in three views.

FIGS. 1 to 8 show an RJ45 connector 1 according to the invention in accordance with a first embodiment of the present invention. The RJ45 connector 1 comprises a housing 2, with two housing shells 3, 4, which are held to one another pivotably. A closed position of the housing 2 is shown by way of example in FIG. 1, whereas FIG. 4 or 6 show the housing 2 in the open state.

The RJ45 connector 1 further comprises a baseboard 10, which is fitted to a first housing shell 3 of the housing 2. The baseboard 10 is held here parallel to a wall 11 of the first housing shell 3. The RJ45 connector 1 further comprises a plurality of identical insulation displacement contacts 12, which are arranged in two parallel rows 14, 16 on the baseboard 10. Each of the rows 14, 16 comprises four insulation displacement contacts 12, which are positioned in an offset manner on the baseboard in such a way that the four insulation displacement contacts 12 of each row 14, 16 are arranged side by side in two groups, wherein the two groups are positioned in a laterally offset manner and one behind the other.

The RJ45 plug 1 is configured for connection to a cable 10 having eight conductors 22, wherein the conductors 22 are to be connected to the insulation displacement contacts 12 on the baseboard 10. A longitudinal direction 24 of the cable 20 to be connected corresponds to a longitudinal direction of the RJ45 connector 1 and the direction in which the two rows 14, 16 of the insulation displacement contacts are arranged one behind the other at a distance from one another.

The RJ45 connector 1 further comprises a guide device 30, which is fitted to a second housing shell 4. The guide device 30 in this exemplary embodiment comprises two individual guide elements 31, which are shown in detail in FIGS. 9 and 10. The guide device 30 comprises insertion openings 32, which can be formed in the conductors 22 of the cable 20. The insertion openings 32 are adjoined by trough-shaped ramps 34 for guiding the conductors 22. The ramps 34 are open on the side thereof facing the baseboard 10 and have an arc shape. The ramps 34 adjoin the insertion openings 32 in such a way that the insertion openings 32 constitute a tangential continuance of the ramps 34. The guide device 30 is configured to guide the conductors 22, starting from the baseboard 10, above the insulation displacement contacts 12 of the first row 14 for connection to the insulation displacement contacts 12 of the second row, which is further from the end of the cable.

As can also be seen from FIGS. 9 and 10, the guide elements 31 have guide portions 35, which are formed as guide channels and which extend in a plane parallel to the baseboard 10, The guide channels 35 are configured to accept and guide the conductors 22 for connection to the insulation displacement contacts 12 of the two rows 14, 16. Furthermore, the guide device 30, in the region of the guide channels 35, has immersion pockets 36 for accepting the insulation displacement contacts 12. This concerns both the insulation displacement contacts 12 of the first row and also those of the second row 16. The immersion pockets 36 are formed on the axial edges thereof with clamping elements 38, with which the conductors 22 can be held in a clamped manner.

A preferred use of the RJ45 connector 1 for connection to the cable 20 will be explained below.

The housing 2 of the RJ45 connector 1 is initially opened so as to be able to introduce the cable 20 with the conductors 22. In this position, the conductors 22 for connection to the insulation displacement contacts 12 of the second row 16 are introduced into the insertion openings 32 and are curved along the ramp 34, as can be seen in FIGS. 3 and 4. The conductors 22 are then pressed into the ramps 34, in the region into the corresponding guide channels 35 with the immersion pockets 36, where they are held in a clamped manner between the clamping elements 28, as is shown by way of example in FIGS. 5-7. The free ends of the conductors 22 can be cut off flush at the end of the corresponding guide channels 35. FIGS. 5 and 6 accordingly show the RJ45 connector 1 with the clamped conductors 22 for connection to the insulation displacement contacts 12 of the second row 16.

Furthermore, the conductors 22 for connection to the insulation displacement contacts 12 of the first row 14 are inserted into the corresponding guide channels 35 and are clamped between the clamping elements 38. Ends of the conductors 22 protruding beyond the guide channels 35 can then be cut off flush at their ends facing away from the cable 20. Here, any damage to the conductors in the ramp 34 is prevented by the trough shape. The guide device 30 with the clamped conductors 22 for use with all insulation displacement contacts 12 is shown in FIGS. 5 and 6.

As is clear from the figures, the clamping of the conductors 22 is primarily independent of the positioning thereof, such that the clamping can also be performed following the positioning of all conductors 22.

The housing 2 is closed by pivoting the two housing shells 3, 4 relative to one another, as is shown in FIG. 7. Here, the insulation displacement contacts 12 are introduced into the respective immersion pockets 36, and the conductors 22 are automatically contacted by the corresponding insulation displacement contacts 12.

LIST OF REFERENCE SIGNS

RJ45 connector 1
housing 2
first housing shell 3
second housing shell 4
baseboard 10
wall 11
insulation displacement contact 12
$1^{st}$ row, close to the end of the cable 14
$2^{nd}$ row, further from the end of the cable 16
cable 20
conductors 22
guide device 30
guide element 31
insertion opening 32 ramp 34
guide portion, guide channel 35
immersion pocket 36
clamping element 38

The invention claimed is:

1. An RJ45 plug connector, comprising:

a planar baseboard for connecting to conductors of a cable, and a plurality of insulation displacement contacts to accept the conductors, wherein:

the insulation displacement contacts are arranged in two rows on one side of the planar baseboard, the two rows are positioned at a distance from one another in the longitudinal direction of the cable to be connected, and the RJ45 plug connector comprises a guide device to guide the conductors for connection to the row of insulation displacement contacts that is further away from the end of the cable, characterised in that:

the guide device has ramps made in an arc shape to guide the conductors to the row of insulation displacement contacts that is further away from the end of the cable.

2. The RJ45 plug connector according to claim 1, characterised in that the guide device is configured to guide all conductors of the cable for connection to the insulation displacement contacts.

3. The RJ45 plug connector according to claim 1, characterised in that the ramps are open on the side thereof facing the planar baseboard.

4. The RJ45 plug connector according to claim 1, characterised in that the guide device has insertion openings, into which the conductors can be introduced.

5. The RJ45 plug connector according to claim 1, characterised in that the insulation displacement contacts of the first and second row are identical.

6. The RJ45 plug connector according to claim 1, characterised in that the guide device is configured to guide the conductors, starting from the planar baseboard, above the insulation displacement contacts of the first row for connection to the insulation displacement contacts of the second row.

7. The RJ45 plug connector according to claim 1, characterised in that the RJ45 connector comprises a housing, on which the guide device is held.

8. The RJ45 plug connector according to claim 7, characterised in that:

the housing has two housing shells and the planar baseboard is mounted on the first housing shell and the guide device is mounted on the second housing shell.

9. The RJ45 plug connector according to claim 8, characterised in that the housing shells are interconnected pivotably.

10. The RJ45 plug connector according to claim 7, characterised in that the planar baseboard is mounted parallel to a wall of the housing.

11. The RJ45 plug connector according to claim 1, characterised in that the guide device has immersion pockets for accepting the insulation displacement contacts.

12. The RJ45 plug connector according to claim 1, characterised in that the guide device has clamping elements and is configured to hold the conductors in a clamped manner by means of the clamping elements.

13. The RJ45 plug connector according to claim 1, characterised in that the guide device has a guide portion, which extends in a plane parallel to the planar baseboard.

14. The RJ45 plug connector according to claim 1, characterised in that the guide device is produced from plastic.

15. The RJ45 plug connector according to claim 2, characterised in that the ramps are open on the side thereof facing the planar baseboard.

16. The RJ45 plug connector according to claim 2, characterised in that the guide device has insertion openings, into which the conductors can be introduced.

17. The RJ45 plug connector according to claim 3, characterised in that the guide device has insertion openings, into which the conductors can be introduced.

18. The RJ45 plug connector according to claim 15, characterised in that the guide device has insertion openings, into which the conductors can be introduced.

19. The RJ45 plug connector according to claim 2, characterised in that the insulation displacement contacts of the first and second row are identical.

20. The RJ45 plug connector according to claim 3, characterised in that the insulation displacement contacts of the first and second row are identical.

* * * * *